United States Patent [19]

Hibbs, Jr. et al.

[11] Patent Number: 4,605,343

[45] Date of Patent: Aug. 12, 1986

[54] SINTERED POLYCRYSTALLINE DIAMOND COMPACT CONSTRUCTION WITH INTEGRAL HEAT SINK

[75] Inventors: Louis E. Hibbs, Jr., Schenectady; George C. Sogoian, Scotia, both of N.Y.

[73] Assignee: General Electric Company, Schenectady, N.Y.

[21] Appl. No.: 652,242

[22] Filed: Sep. 20, 1984

[51] Int. Cl.[4] ..... B24B 1/00

[52] U.S. Cl. ..... 407/119; 51/295; 51/309; 76/101 R; 76/DIG. 12; 125/39; 175/329; 407/118; 428/634; 428/663

[58] Field of Search ..... 407/118, 119; 408/144, 408/145; 76/101 R, 101 A, DIG. 12; 51/307, 309, 295; 125/39; 175/329, 330, 409, 410; 428/618, 660–663, 668, 671, 672, 674, 634

[56] References Cited

U.S. PATENT DOCUMENTS

| | | | |
|---|---|---|---|
| 1,524,218 | 1/1925 | Smith et al. | 428/634 |
| 2,365,965 | 12/1944 | Littmann | 407/118 |
| 3,481,825 | 12/1969 | Darrow | 76/DIG. 12 |
| 3,741,735 | 6/1973 | Buttle | 428/663 |
| 3,826,630 | 7/1974 | Roy | 428/634 |
| 3,856,480 | 12/1974 | Johnson et al. | 428/634 |
| 3,868,750 | 3/1975 | Ellis et al. | 407/118 |
| 4,203,690 | 5/1980 | Tanaka et al. | 407/119 |
| 4,535,216 | 8/1985 | Cassidenti | 82/1 C |
| 4,539,018 | 9/1985 | Whangler et al. | 51/309 |

FOREIGN PATENT DOCUMENTS

| | | | |
|---|---|---|---|
| 19461 | 11/1980 | European Pat. Off. | 407/118 |
| 140284 | 10/1979 | Japan | 407/118 |

*Primary Examiner*—Francis S. Husar
*Assistant Examiner*—Jerry Kearns
*Attorney, Agent, or Firm*—James Magee, Jr.; James C. Davis, Jr.

[57] ABSTRACT

A sintered polycrystalline diamond compact having an integral metallic heat sink bonded to and covering at least the outer diamond surface is used to increase compact life when the compact is used for material removal without a fluid coolant.

6 Claims, 6 Drawing Figures

SINTERED POLYCRYSTALLINE DIAMOND COMPACT CONSTRUCTION WITH INTEGRAL HEAT SINK

BACKGROUND OF THE INVENTION

The use of commercial sintered polycrystalline diamond compacts for the removal of materials in which the operations are conducted dry (i.e., without coolant fluid circulation over the tool) is limited because of the frictional heat generated at the rubbing interface between the diamond layer and the material being cut. If the temperatures generated by this frictional heat are permitted to become high enough, damage to the sintered diamond structure will occur and result in markedly increased cutter wear rates. Examplary tool constructions are disclosed in U.S. Pat. No. 3,745,623—Wentorf and Rocco.

Extensive experiments in which the wear of stud-mounted sintered polycrystalline diamond drill blanks was quantitatively measured while cutting an abrasive rock (Nugget Sandstone) under both dry and wet (water base coolant) conditions clearly illustrate the problem. Tests conducted over a speed range extending from 104–443 ft./min. demonstrated that the volume of diamond wear was independent of speed and was a linear function of the length of cut (i.e., distance cut), for both the dry and wet conditions.

It was also found that by using the water base coolant to remove the frictionally generated heat, the diamond wear rate was reduced by 93.8%.

DESCRIPTION OF THE INVENTION

This invention is directed to several alternate constructions by which the removal of heat from a sintered polycrystalline diamond compact used as a cutting tool is facilitated. The resulting tool insert structures are better able to survive dry cutting, because of the provision by this invention for reducing the thermal damage usually caused in such usage.

In each of the alternate constructions disclosed, a metallic heat sink is bonded to and covers at least the outer surface of the diamond layer (i.e., the surface away from the substrate supporting the sintered diamond layer). The heat sink layer is to be between about 0.010 and about 0.100 in. thick. The preferred heat sink material is copper, although particular applications may require other metals or alloys in order to provide added resistance to wear and erosion by debris from the cutting process. The metallic heat sink is bonded to the diamond surface via an intermediate layer about 100 to about 200 Angstroms thick of molybdenum, tungsten, titanium, zirconium or chromium. Molybdenum is the preferred bonding material. Additional optimized constructions are described herein.

BRIEF DESCRIPTION OF THE DRAWINGS

The features of this invention believed to be novel and unobvious over the prior art are set forth with particularity in the appended claims. The invention itself, however, as to the organization, method of operation and objects and advantages thereof, may best be understood by reference to the following description taken in conjunction with the accompanying drawings wherein:

MANNER AND PROCESS OF MAKING AND USING THE INVENTION

Figure 1:
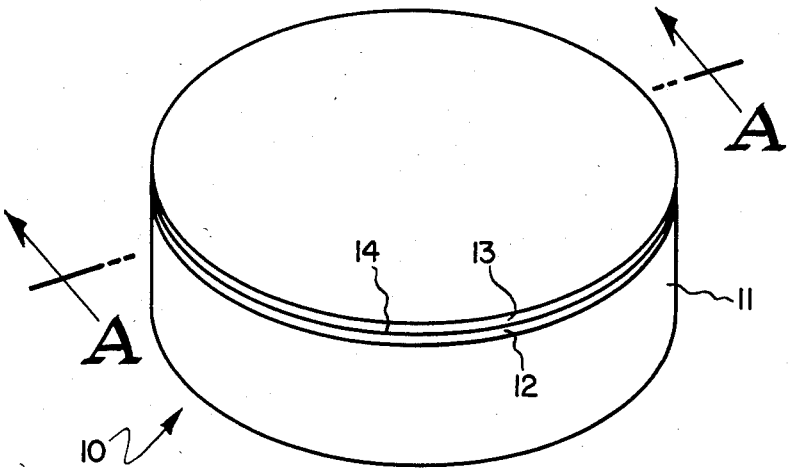
FIG. 1 is a three dimensional schematic view showing the metallic heat sink superimposed over the sintered polycrystalline diamond layer of a diamond compact tool insert.

The tool construction 10 shown in FIG. 1 is made up of cemented carbide (e.g., cobalt bonded tungsten carbide) substrate 11 formed integral with sintered polycrystalline diamond layer 12, this composite in turn being bonded to metallic heat sink layer 13 by means of a thin bonding medium, or bonding laminate, 14. The composite of substrate 11 and diamond layer 12 is commercially available (e.g., STRATAPAX ® drill blanks; COMPAX ® tool blanks manufactured by the General Electric Company).

Figure 2:
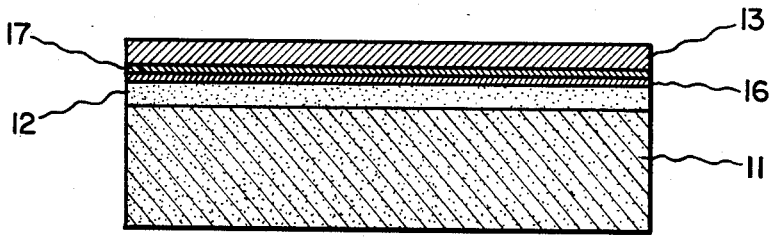
FIG. 2 is a schematic sectional view taken on line A—A of FIG. 1 in which a two-component bonding laminate is employed to affix the metallic heat sink to the diamond layer.

A first embodiment of this invention is illustrated in FIG. 2. Heat sink layer 13 should be between about 0.010 and about 0.100 in. thick with the preferred heat sink material being substantially pure copper. This heat sink layer 13 is bonded to the surface of polycrystalline bonded layer 12 via the bonding medium comprising a very thin (e.g., from about 100 to about 200 Angstroms thick) layer 16 of a metal from the group consisting of molybdenum, tungsten, titanium, zirconium or chromium. These metals, of which molybdenum is the preferred material, are used for this layer 16, because they have the capability of bonding to a diamond surface. Layer 16 is applied by sputtering. Although it is not critical, it is desirable to cover layer 16 with a protective layer 17 to prevent oxidation or contamination of layer 16 until heat sink layer 13 has been applied. Protective layer 17 of gold, platinum, copper or nickel would be applied by sputtering in a thickness ranging from about 100 to about 200 Angstroms. Gold is the preferred protective layer material because of its oxidation resistance and its compatibility with the after-to-be-applied layer 13, which is usually copper.

Thereafter, heat sink layer 13 is applied by electrodeposition, electroless deposition, vapor deposition, plasma spray or hot isostatic pressing. The last two processes are conducted at elevated temperature and care must be taken that the process temperature does not exceed 700° C. in order to avoid thermal damage to the sintered diamond layer 12.

For those applications in which cutter 10 is to be brazed to operating support means, such as a larger tungsten carbide substrate or stud, or brazed to a steel mining tool shank or steel drill bit stud, the heat sink layer 13 should be applied to layer 17 (or layer 16, if layer 17 is not employed), before brazing of cutter 10 to the operating support means.

The preferred method for applying the heat sink material comprising layer 13 is electrodeposition, providing that the plating solution used produces a substantially pure copper deposit. Plating formulations employed for producing bright decorative coatings are not suitable if they contain large amounts of organic additives. The inclusion of such additives in the deposited copper will result in a brittle layer of lower thermal conductivity.

The as-deposited heat sink material should be machined or ground to the desired thickness to produce the ultimate layer 13 such that the outer surface thereof is flat and substantially parallel to the underlying surface of the cemented carbide substrate 11.

In the event that additional wear or erosion resistance is needed over and above that supplied by the use of copper as the heat sink material, substitutions for the copper can be made. These substitutions would be cobalt, nickel or iron, each alloyed with tungsten. Methods for producing electrodeposits of such alloys are disclosed in "Electrodeposition of Alloys, Vol. II" by Abner Brenner [Academic Press, New York, pp. 351-396 (1963)]. The cobalt-tungsten alloys may be heat treated to increase the hardness and erosion resistance thereof. Such heat treatment can be conducted at temperatures below that which will damage the diamond layer 12. As an alternate, electroless nickel containing some phosphorous may be used as the material for the heat sink layer. These nickel phosphorus alloys may also be hardened by low temperature heat treatment.

Figure 4:
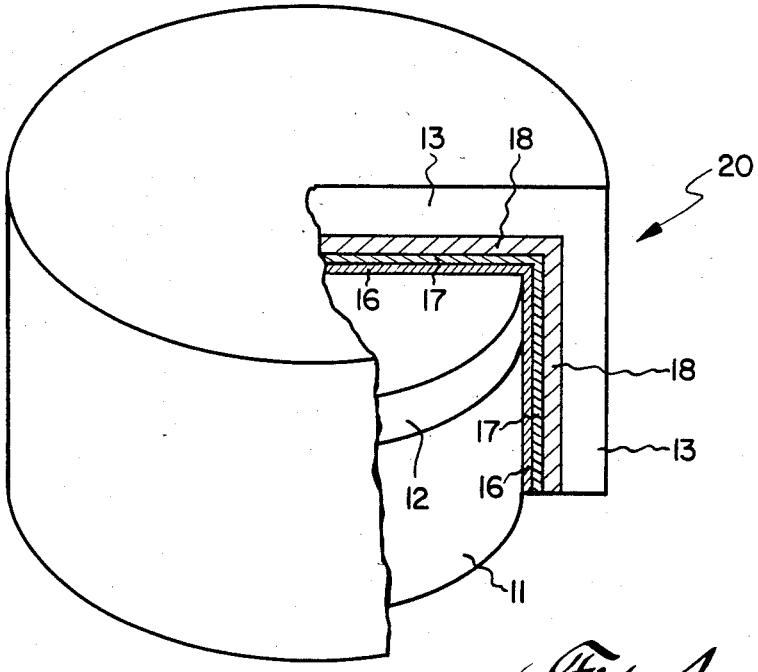
FIG. 4 is a schematic three dimensional view partly broken away to illustrate a third embodiment of this invention.
Figure 5:
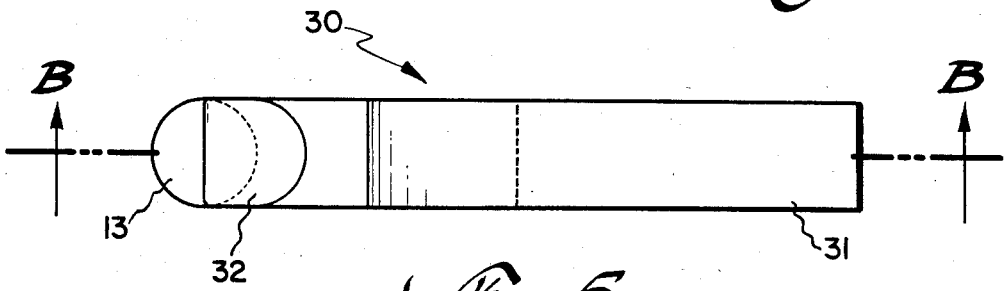
FIG. 5 is a schematic plan view of a coal cutter tool embodying this invention wherein the heat conductivity is enhanced by the provision of an enlarged path for heat conductivity from the cutting tool to the tool shank and FIG. 6 is a schematic sectional view taken on line B—B of FIG. 5.
Figure 6:
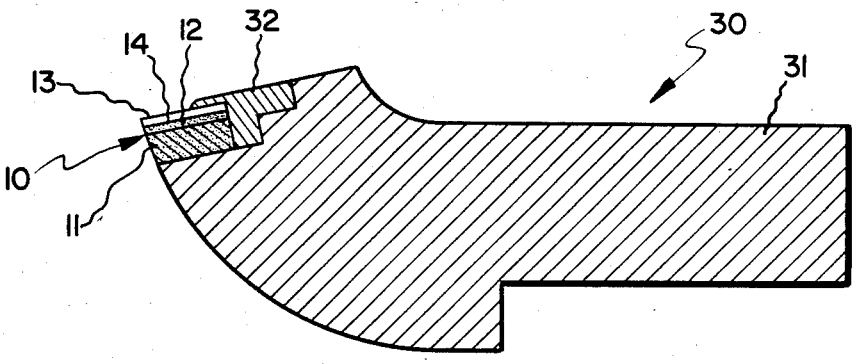

When diffusion bonding, which uses the hot isostatic pressing process, is to be used to affix substrate 11 to a larger operating support, such as a substrate of cemented carbide or steel, a tool shank, a bit body or a stud, heat sink layer 13 may be bonded simultaneously during the diffusion bonding to layer 17 using a preformed metal disk to form layer 13 (or the top and side covering cap shown in FIG. 4). The temperature and pressure used during the diffusion bonding process (650°-700° C. and 15,000-30,000 psi) are sufficient to bond the pre-formed heat sink securely to the bonding medium employed. Such an operating substrate is shown in FIGS. 5 and 6.

When the simultaneous diffusion bonding and heat sink bonding are employed to provide the construction of FIG. 2, an assembly consisting of substrate 11, diamond layer 12, layer 16 and layer 17 is prepared to enter the diffusion bonding operation as a unit.

Figure 3:
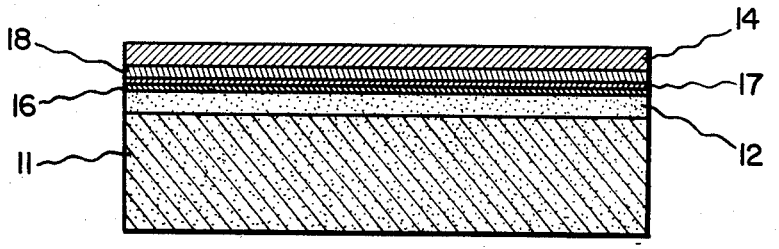
FIG. 3 is a schematic sectional view taken on line A—A of FIG. 1 in which a three-component bonding laminate is employed to affix the metallic heat sink to the diamond layer.

In the embodiment shown in FIG. 3, substrate 11, diamond layer 12, layer 16 and layer 17 are provided in the same manner and of the same materials as previously described. A third outer coating 18 ranging in thickness from about 10,000 to about 20,000 Angstroms is bonded to layer 17. The construction of FIG. 3 is recommended in those instances in which additional protection is considered desirable for the relatively fragile layers 16 and 17. The concern is with damage that can occur during handling and fixturing such as is employed to prepare for diffusion bonding of the cemented carbide substrate 11 to an operational support as described above. The preferred metal employed for layer 18 is copper, this layer being deposited by sputtering, vapor deposition, electrodeposition or electroless deposition. Other useful materials are silver and copper-silver alloys. After layer 16 has been bonded to diamond layer 12, layer 18 can be applied directly to layer 16 by sputtering or vapor deposition so long as the surface of layer 18 has not previously been exposed to the atmosphere.

The embodiment of FIG. 4 is the most preferred configuration for the bonding medium regardless of the method used for attachment of heat sink layer 13. This embodiment provides for extending heat sink 13 down the side of cutter 20 thereby providing an additional path for the removal of heat from cutter 20 through the tool shank, bit body or stud on which the cutter is supported. In addition, it provides extra protection for diamond layer 12 in the event that the heat sink material for layer 13 contains iron, cobalt or nickel and attachment is made by diffusion bonding. Contact between the diamond in layer 12 and any of iron, cobalt or nickel at diffusion bonding temperatures will cause graphitization of the diamond and damage the sintered structure of layer 12. As is shown in FIG. 4, for this embodiment, layers 16, 17 and 18 are carried down the side of the structure to provide requisite bonding to the edge of diamond layer 12. Extending these layers below layer 12 so as to cover the side of substrate 11 is done primarily for convenience.

In the event that diffusion bonding is to be employed for affixing the underside of substrate 11 to an additional substrate (not shown) as described hereinabove, heat sink layer 13 can be supplied in the form of a preformed cap.

FIGS. 5 and 6 illustrate the application of this invention to produce improved coal cutter 30. This particular construction provides for enhanced heat removal from the cutting edge of the cutter. The configuration of cutter 10 is shown, by way of example, and cutter 20 could, of course, be used in its place. Cutter 10 has been affixed in a pocket, or recess, of steel tool shank 31, as by diffusion bonding. Illustration of this invention as applied to a coal cutter tool is merely by way of example and the teachings are equally applicable to tools for machining and drilling. In addition to affixing cutter 10 as shown, provision is made for maximizing heat removal efficiency therefrom by the application of copper mass 32 in contact with an overlying part of cutter 10. The copper can be applied in a dense pure form utilizing low pressure plasma spray techniques. An abrasion/erosion resistance material can be plasma sprayed as a layer (not shown) over the copper without reducing the heat removal capability of the copper mass appreciably since the cutter-to-air heat exchange is poor to being with.

What is claimed is:

1. In a composite tool insert construction in which a layer of sintered polycrystalline diamond is supported on and bonded to a cemented carbide substrate, the improvement comprising a metallic heat sink layer having a thickness between about 0.01 and 0.1 inches and covering at least the outer diamond surface of said diamond layer, said heat sink layer being selected from the group consisting of copper, tungsten alloyed with cobalt, and nickel or iron and nickel phosphorus alloys, and said heat sink layer being bonded to said diamond surface via a bonding medium comprising at least one intermediate layer of metal selected from the group consisting of molybdenum, tungsten, titanium, zirconium and chromium.

2. The improvement of claim 1 wherein the bonding medium is a bonding laminate consisting of the layer bonded to the diamond and a protective layer interposed between and bonded to both said layer bonded to the diamond and the heat sink layer, the material of said protective layer being selected from the group consisting of gold, platinum, nickel and copper.

3. The improvement of claim 1 wherein the bonding medium is a bonding laminate consisting of the layer bonded to the diamond, a first protective layer bonded to said layer bonded to the diamond, a thicker second protective layer bonded on one side to said first protective layer and on the opposite side to the heat sink layer, the material of said first protective layer being selected from the group consisting of gold, platinum, nickel and copper and the material of said second protective layer being selected from the group consisting of copper, silver and copper-silver alloys.

4. In a composite tool insert construction in which a layer of sintered polycrystalline diamond is supported on and bonded to a cemented carbide substrate, the improvement comprising a metallic heat sink layer having a thickness between about 0.01 and 0.1 inches and covering the surface of said polycrystalline diamond layer opposite said carbide substrate, said heat sink layer being selected from the group consisting of copper, tungsten alloyed with cobalt, and nickel or iron and nickel phosphorus alloys, and said heat sink layer being bonded to said polycrystalline diamond surface via a bonding medium comprising at least one intermediate layer of metal selected from the group consisting of molybdenum, tungsten, titanium zirconium and chromium.

5. The improvement of claim 4 wherein the bonding medium is a bonding laminate consisting of the layer bonded to the diamond and a protective layer interposed between and bonded to both said layer bonded to the diamond and the heat sink layer, the material of said protective layer being selected from the group consisting of gold, platinum, nickel and copper.

6. The improvement of claim 4 wherein the bonding medium is a bonding laminate consisting of the layer bonded to the diamond, a first protective layer bonded to said layer bonded to the diamond, a thicker second protective layer bonded to one side to said first protective layer and on the opposite side to the heat sink layer, the material of said first protective layer being selected from the group consisting of gold, platinum, nickel and copper and the material of said second protective layer being selected from the group consisting of copper, silver and copper-silver alloys.

* * * * *